United States Patent [19]

Farcasiu et al.

[11] 4,293,404

[45] Oct. 6, 1981

[54] DEHYDROXYLATION AND/OR DEMERCAPTOLATION OF HEAVY PETROLEUM OILS

[75] Inventors: Malvina Farcasiu, Princeton; Darrell D. Whitehurst, Titusville, both of N.J.

[73] Assignee: Mobil Oil Corporation, New York, N.Y.

[21] Appl. No.: 170,406

[22] Filed: Jul. 21, 1980

[51] Int. Cl.[3] ..... C10G 45/24; C10G 45/28

[52] U.S. Cl. ..... 208/214; 208/263; 208/56

[58] Field of Search ..... 208/214, 263, 56

[56] References Cited

U.S. PATENT DOCUMENTS

| | | | |
|---|---|---|---|
| 2,253,308 | 8/1941 | Rosen | 208/214 |
| 2,703,780 | 3/1955 | Voorhies | 208/214 |
| 4,046,668 | 9/1977 | Farcasiu et al. | 208/11 LE |

*Primary Examiner*—Delbert E. Gantz
*Assistant Examiner*—Olik Chaudhuri
*Attorney, Agent, or Firm*—Charles A. Huggett; Michael G. Gilman; Charles J. Speciale

[57] ABSTRACT

The phenolic oxygen and/or the thiol sulfur present in the polycyclic aromatic compounds in a heavy oil, such as vacuum pipestill bottoms, crude oil, reduced crude, residual oil or tar sands oil, can be removed as $H_2O$ and/or $H_2S$ by contacting the heavy oil with a hydrogen donor at an elevated temperature in the presence of a specified catalyst.

15 Claims, No Drawings

DEHYDROXYLATION AND/OR DEMERCAPTOLATION OF HEAVY PETROLEUM OILS

BACKGROUND OF THE INVENTION

This invention relates to the processing of petroleum-based heavy oils and residual oils, particularly those derived from tar sands. More particularly this invention relates to reducing the viscosity and the sulfur content of tar sand oil so that it may be more readily pumped and processed by available petroleum processing equipment. This invention is especially concerned with the removal of phenolic oxygen and/or thiol sulfur from the polycyclic aromatic compounds found in heavy oils, residual oils and, particularly, tar sand oils.

Major tar sand deposits are found in the Athabasca region of Alberta in Canada, as well as, in Utah and Oklahoma of the United States and in Venezuela. To date, this source of oil has not constituted a significant portion of the crude oil utilized in the free world. The cost of extracting oil from the tar sands by currently available technology has not made it economically attractive. Further, the nature of the tar sand oil does not make the use of conventional petroleum processing feasible—this oil is highly viscous, high in sulfur and high in metals content. However, the increasing cost of crude oil makes tar sand oil increasingly attractive economically. This is particularly so if mining procedures to recover the tar sand oil and initial processing techniques to produce a less viscous tar sand oil with lower sulfur and metals content are available at commercially attractive costs. The upgrading of the tar sands oil in field gathering stations is highly desirable so that conventional crude oil pipeline and pumping equipment and petroleum processing equipment can be employed to produce consumer products.

A summary of some of the properties of typical tar sand oils is set forth in Table I below.

TABLE I

TAR SAND OIL PROPERTIES

| Source | Oxygen Content, % | Sulfur Content, % | Polar Compounds (Phenol-containing), % |
|---|---|---|---|
| Athabasca | 2.9 | 4.8 | 28 |
| North Asphalt Ridge, Utah | 2.9 | — | 20 |
| Oil Creek, Oklahoma | 3.0 | 2.3 | 35 |

Oxygen content is in the range of 1–3% and sulfur in the range of 4–6% and even as high as 12% for different tar sands. About 70–75% of the oxygen is phenolic oxygen. Sulfur is present predominantly as disulfide, thiophenes and heterocyclic sulfur. Very little thiol sulfur is found, as such, since it readily forms disulfide linkages which are easily broken during subsequent processing. For purposes of the present disclosure and claims the term "phenolic oxygen" is used to identify the oxygen in the -OH group attached to polycyclic aromatic compounds and the term "thiol sulfur" is used to identify the sulfur in the -SH group attached to polycyclic aromatic compounds. As used herein, the term "polycyclic compounds" includes dicyclic compounds. Unless stated otherwise, percent, as used in this disclosure and claims, is weight percent.

The phenolic OH found in the polycyclic aromatic compounds of tar sand oil causes a significant increase in the oil's viscosity due to hydrogen bonding. Thiol sulfur found in similar compounds is also undesirable because of the deleterious effect it has on petroleum processing catalysts which it can rapidly and irreversibly deactivate. Additionally, this sulfur greatly increases the corrosiveness of the heavy oil.

It is an object of the present invention to produce a heavy oil having a lower phenolic oxygen and/or thiol sulfur content so that the oil may be transported and processed in conventional pumping and processing equipment currently employed in the petroleum industry.

SUMMARY OF THE INVENTION

In accordance with the present invention, it has been found that the phenolic oxygen and/or the thiol sulfur content of heavy oil, particularly tar sand oil, can be significantly reduced by contacting the oil at an elevated temperature with a hydrogen donor and a catalyst which is an iron-containing porous solid, coal or coal liquefaction residue. This invention is directed to a process for removing phenolic oxygen and/or thiol sulfur from heavy petroleum oils which comprises:

(a) contacting heavy petroleum oils containing polycyclic hydroxy and/or thio aromatic compounds with effective amounts of a hydrogen donor, and a catalyst of an iron-containing porous solid, coal or coal liquefaction residue, (b) heating the mixture of (a) at elevated temperatures to evolve $H_2O$ and/or $H_2S$ from said mixture.

DESCRIPTION OF THE PREFERRED EMBODIMENTS

Broadly, the present invention is practiced by mixing a heavy oil containing polycyclic hydroxy and/or thio aromatic compounds with a hydrogen donor and a catalyst at an elevated temperature to evolve $H_2O$ and $H_2S$ from the mixture. The catalyst is an iron-containing porous solid, coal or coal liquefaction residue. The heavy oil recovered has a lower viscosity which improves its pumping characteristics and a lower sulfur content which makes the oil more susceptible to conventional petroleum processing. The process of the present invention unexpectedly promotes the removal of OH and/or SH groups from polycyclic aromatic rings without the usual hydrocracking reactions which take place with such catalysts as those containing cobalt-molybdenum.

By "heavy oil" is meant a relatively high boling petroleum based oil, such as vacuum pipestill bottoms, crude oil, reduced crude, heavy residual oil or oil recovered from tar sands. The "heavy oil" which may serve as the feed in the practice of this invention may be described as petroleum-derived bitumen having an API gravity of less than about 16, generally less than about 20, a Conradson carbon of above about 5, a distillate yield of 50% or less and a viscosity of above about 1000 SUS at 100° F. These heavy oils are composed of a great variety of hydrocarbons including polycyclic aromatic compounds which are of major concern during the processing of these heavy oils to produce useful products. The presence of phenolic oxygen and thiol sulfur in the polycyclic aromatics of these heavy oils creates a variety of processing problems—increased puming costs because of high viscosity, excessive corrosion rates and rapid poisoning of processing catalysts.

In addition to the specific examples provided herein, other heavy oils which come within the above description may also benefit from the process of this invention.

In treating the phenolic oxygen and/or thiol sulfur containing polycyclic aromatic compounds by the process of this invention, a hydrogen donor is utilized. Hydrogen donor for the purpose of the present invention is intended to include organic compounds which are capable of providing hydrogen to another molecule at high temperatures, usually by conversion of the donor compound from a hydroaromatic compound to a fully aromatic compound with the release of hydrogen. Hydrogen donors are well-known in the petroleum arts, e.g. as in Hydrogen-Donor-Diluent-Visbreaking (HDDV). For most purposes, hydrogen donors are condensed aromatic ring compounds which are partially hydrogenated such as hydrogenated naphthalenes, e.g., tetrahydronaphthalene (tetralin) and derivatives thereof such as, methyltetralin. Partially hydrogenated refinery streams containing a high concentration of condensed aromatic ring compounds can also serve as the hydrogen donor. Hydrogen donors are also known as thermal hydrogen transfer agents. For the purpose of the present disclosure and the appended claims, the term "hydrogen donor" is meant to be synonymous with thermal hydrogen transfer agent and embraces the aforementioned compounds and classes of compounds.

Regeneration of the hydrogen donor for a continuous process can be brought about by the mere expedient of separation of the dehydrogenated donor, e.g., by fractionation, followed by hydrogenation.

The amount of hydrogen donor employed in the present process can vary over wide ranges depending on the particular compound selected. The ability of the hydrogen donor to be regenerated also effects the amount required since some hydrogen donors are quite rapidly regenerated in situ during the dehydroxylation/demercaptolation process in the presence of hydrogen gas. Further, the ability of these hydrogen donors to produce hydrogen atoms varies greatly. Thus, tetralin has four donatable hydrogens while other compounds, such as 2-cyclohexylphenol have six donatable hydrogens and compounds such as octahydrophenantrene have eight donatable hydrogens per molecule. Multi-membered ring hydrogen donors may be a source of additional hydrogens per molecule. For simplicity, the ability of a particular organic compound or a mixture of organic compounds to function as a hydrogen donor can be related to the hydrogen donor reactivity of tetralin and this equivalency, expressed as tetralin concentration, can be used to describe the amount of hydrogen donor present in the reaction mixture. A tetralin concentration of greater than 10%, i.e. 10–40%, preferably 20–30%, in the heavy oil will provide the required amount of hydrogen donor. Any concentration of other hydrogen donor which produces the same hydrogen donor reactivity of these tetralin concentrations may also be usefully employed. For the purpose of this specification, the term "% tetralin equivalent" as applied to a hydrogen donor shall mean a weight percent concentration of the hydrogen donor in the heavy oil which will produce substantially the same dehydroxylation and/or demercaptolation as the stated concentration of tetralin, all other variables being the same.

A catalyst is required to practice this invention. Several types of materials may be usefully employed. One group of materials may be described generally as iron-containing porous solids, while a particularly effective group of materials which serve as catalysts in the subject invention are coals and coal liquefaction residues. Among the useful iron-containing porous solids are iron pyrites, fly ash, bauxite, red mud (a by-product of processing bauxite), and manganese nodules. The coals include bituminous, sub-bituminous and lignite with bituminous being particularly useful. The residue from a coal liquefaction process may also be used as a catalyst in this process. This residue may be described as any insoluble material that results when coal is dissolved in a coal liquefaction process. Those skilled in the art will recognize that not all materials within the above descriptions will function equally well as a catalyst. For example, some green sands are quite effective while others exhibit lower activity and would not be commercially effective. Since these materials, particularly coal and coal liquefaction residue, are relatively cheap and therefore expendable, they are uniquely suited for use in processing heavy oils, resids and tar sand oils which often foul more expensive commercial catalysts.

The catalyst may be employed in a means most adaptable to the particular processing technique being employed. Thus, in a continuous processing mode, a solid catalyst could be confined in a fixed bed while the reaction mixture is passed therethrough. The bed could be replaced when its activity has been significantly reduced. In another embodiment, the catalyst in particulate or finely divided form could be added to the feed upstream of the dehydroxylation/demercaptolation reactor and recovered from the product stream after it passes from the reactor. Where the activity of the recovered catalyst warrants it, the catalyst could be recycled for further use. Those skilled in the art can appreciate that other well known means of contacting reactants with a solid catalyst may also be employed. Similarly, where the condition of the catalyst and the economics warrant it, a depleted catalyst can be regenerated for re-use by any of the well known techniques available, such as oxidative and/or hydrogenative regeneration.

The hydrogen donor can be added to the heavy oil feed and the resultant mixture heated to the required processing temperature or the feed and the hydrogen donor may be introduced separately to the reactor. The process may be carried out at atmospheric pressure in a vented reactor or at elevated pressure in a closed system. Where a fixed bed of catalyst is employed the process is conveniently conducted in a reactor vessel. If the catalyst is incorporated with the mixture of heavy oil and hydrogen donor, a reactor vessel or a tubular reactor may be employed as long as the necessary hydrogen atmosphere is provided.

Added gaseous hydrogen is desirably present during the reaction. This may be provided from any conventional source of hydrogen, such as, for example the surplus hydrogen from a reforming process or hydrogen produced by the partial oxidation of hydrocarbons. Since water vapor and/or hydrogen sulfide are produced in the subject process, the hydrogen introduced into the reactor need not be of high purity but it must be present even if only at a very low partial pressure. Pressures during the reaction are not critical and may be between 0 and 2500 psig, preferably 0 to 500 psig. The dehydroxylation/demercaptolation is conducted at temperatures in the range of 600–1000° F., preferably 700 900° F. Space velocities of 0.5 to 10 LHSV have been found to be effective in providing the time necessary for the desired reactions. As with most petroleum processes, the process of this invention is preferably conducted on a continuous basis, although where conditions or particular needs dictate otherwise, the process may be performed in a batch-wise fashion.

Since the feedstocks used in this process are unusually viscous thereby necessitating costly pumping and because this process effects a significant reduction in the viscosity of the heavy oil, this invention is ideally practiced in close proximity to the source of the heavy oil. Thus, tar sands oil would preferably be dehydroxylated/demercaptolated at the tar sands field while vacuum pipestill bottoms would be processed in the refinery in the vicinity of the pipestill.

In a preferred embodiment of this invention, a tar sand oil, recovered from a tar sands by an extraction procedure of the invention herein serves as the feed to the dehydroxylation/demercaptolation process. This double extraction procedure, disclosed in U.S. Pat. No. 4,046,668, employes a light naphtha and methanol to separately extract the polar and non-polar compounds from the tar sand. The polar compounds are then treated by the process of this invention to yield a dehydroxylated/demercaptolated product suitable for further treatment by conventional petroleum processing.

The process of this invention may be used in another preferred embodiment where coal is available as a catalyst. In this concept, coal and heavy oil are co-processed with the coal serving as the catalyst and the heavy oil providing at least some of the hydrogen donors. The versatility of this process and its ready adaptability to a variety of situations will be apparent to those skilled in the art who are faced with the problem of processing heavy oils having high content of polycyclic aromatics containing phenolic oxygen and/or thiol sulfur.

One particular effective use of this process will enhance the yields of liquids and gases when coking deasphalted tars and other heavy residues. During coking, the amount of gas, gasoline and gas oil produced from the heavy oil feed by thermal cracking reactions is restricted by the coke formed by competiting condensation reactions which are occurring simultaneously. Phenols have been reported to induce some of these condensation reactions to form isotropic carbon. By treating the feed to a coking process by the subject invention so as to remove phenolic oxygen, the condensation rections, which produce coke during coking, will be reduced with a commensurate increase in liquid and gaseous yields. This pretreatment of the heavy oil feed to the coking process can be carried out effectively by employing a fixed bed of one of the effective catalysts disclosed heretofore and passing the feed stream at elevated temperature through the bed together with a hydrogen donor and a supply of hydrogen. The treated feed, which may be, for example, propane deasphalted tar, reduced crude or heavy resid, can then be passed directly to the coking unit. If necessary, the treated feed can be sent to a disengaging drum to remove entrained gases before being introduced into the coking furnace. In this fashion, the phenolic oxygen of the heavy oil is significantly reduced resulting in a lower coke yield and higher yields of gaseous and liquid products from the coking unit.

The product obtained from the process of this invention is significantly different from the feedstock introduced into the process. Whereas the feed is highly viscous and contains a significant number of polycyclic aromatic compounds containing phenolic oxygen and/or thiol sulfur, the product has a significantly reduced viscosity which makes transporting the heavy oil by pipeline commercially attractive. In addition, the phenolic oxygen and/or thiol sulfur content of the product is at such a sufficiently low value that the corrosiveness of the oil is no longer a significant problem and the downstream processing equipment can be constructed of conventional materials. Further, catalytic processing of the treated heavy oil becomes an attractive option as the heavy oil has a reduced tendency to foul and/or deactivate commercial catalysts. In subjecting a propane deasphalted resid to the process of this invention a significant improvement was noted after ½ hour at 850° F. in the presence of hydrogen and bituminous coal. The distillate yield of the product was 30 vol. % and the molecular weight of the resid had been reduced from about 2000 to about 600.

The following examples will serve to illustrate the process of this invention.

EXAMPLE 1

A series of runs were made using a small autoclave to evaluate the effect of coal on the cleaving of phenolic oxygen from polycyclic aromatics.

In the runs utilizing coal, about 4 grams of 2-methylnaphthalene were placed in the autoclave which was then sealed and pressured up to about 1500 psig with a 90/10 mixture of $H_2$/He. A slurry of 2 grams of coal in a mixture of 4 grams of tetralin and 2 grams of 2-naphthol, 5-hydroxytetralin or 1-napthol were then injected into the autoclave. A brass heating block at a temperature of 970° F. was inserted into the autoclave. After a heat-up time of 3–5 minutes, a temperature of 800° F. was obtained and stabilized by blowing air over the heating block. All runs were for 90 minutes at 800° F.±10° F. Reactions were terminated by quenching the autoclave with water to achieve a cool down to room temperature in 1–2 minutes.

Where coal was not used in a run, it was conducted as above except that all the reagents were placed in the autoclave which was then sealed and pressured.

The results are shown in Table II below:

TABLE II

| | Run No. | | | | | | | |
|---|---|---|---|---|---|---|---|---|
| | 1 | | 2 | | 3 | | 4 | |
| Compounds | I | F | I | F | I | F | I | F |
| Metylindan | | | — | 0.14 | | | | 0.08 |
| Tetralin | 3.99 | 3.04 | 4.02 | 3.56 | 4.03 | 3.66 | 4.00 | 3.66 |
| Naphthalene | | 1.19 | | 0.34 | | 0.76 | | 0.35 |
| Methyltetralin | | | | 0.04 | | 0.16 | | 0.08 |
| 2-Methylnaphthalene | 4.09 | 4.09 | 3.98 | 3.92 | 4.11 | 3.95 | 4.00 | 3.92 |
| Non-identified | | | | 0.10 | | | | 0.13 |
| 5-Hydroxytetralin | | | | — | 2.00 | 1.45 | | |
| 6-Hydroxytetralin | | | | 0.02 | | | | |
| 1-Naphthol | | | | | — | 0.21 | 2.00 | 1.81 |
| 2-Naphthol | 2.00 | 0.97 | 1.99 | 1.67 | | | | |
| Heavy | | 0.40 | | 0.03 | — | 0.04 | | 0.14 |
| Burning Star Coal | 2.00 | | | | 2.00 | | — | |

*All data normalized relative to 2-methylnaphthalene and derivatives thereof.
I = Initial
F = Final
These data are presented on a mole basis and are normalized for 1 mole of tetralin in Table III below.

TABLE III

DEHYDROXYLATION OF POLYCYCLIC PHENOLS

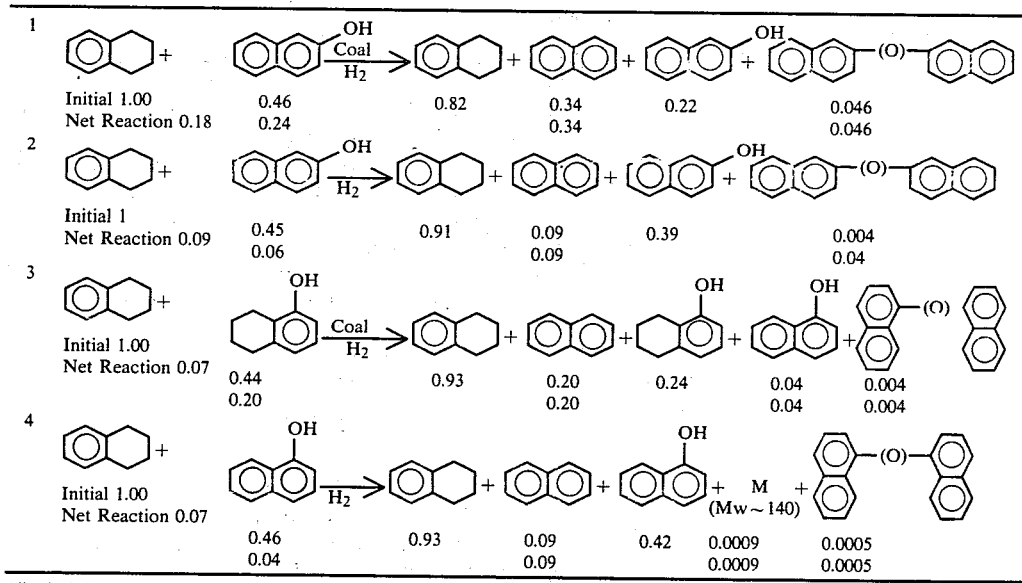

All calculations normalized for 1 mole tetralin in the initial mixture. Methylnaphthalene not included in calculations. All reactions at 800° F., 90 min. Coal (when used) was Burning Star.

The only runs in which appreciable dehydroxylation occurred were in Run Nos. 1 and 3 where the reaction was conducted in the presence of coal.

EXAMPLE II

The ability of a variety of materials to act as a catalyst in the removal of phenolic oxygen from a heavy oil was evaluated by using a fixed bed of each of the materials in a series of runs. In each instance the feedstock was a heavy oil containing 9.9% 1-naphthol as the phenolic oxygen polycyclic aromatic. Each run was conducted in the presence of hydrogen. The fixed bed reactor was operated at 700° F. and an LHSV of 2.0. The results are listed in Table IV below:

TABLE IV

| Material | 1-Naphthol In Product, % |
|---|---|
| Cobalt-molybdenum | 0 |
| Vycor chips | 6.7 |
| Green Bay Mn nodules | 0 |
| Pacific Mn nodules | 3.1 |
| Porocel bauxite | 4.1 |
| Con Edison fly ash | 3.8 |
| Coal liquifaction solids (Wilsonville, Ala.) | 4.4 |
| N. J. Green sand | 9.9 |
| Mn green sand | 5.3 |
| Iron pyrites | 3-6 |
| Red mud (by-product of processing bauxite) | 5-6 |

Of the materials tested, the Vycor chips (glass) and the N. J. Green sand were not sufficiently active to be considered for use in an effective process. The cobalt-molybdenum combination was very effective in this screening test. However, it is the type of catalyst which would be contaminated by some of the heavy oils which serve as feed in the present invention and thus it is not ideally suited as one of the useful and expendable catalysts. The remaining materials are all relatively inexpensive and evidence sufficient catalytic activity to be usefully employed in the subject invention.

What is claimed is:

1. A process for removing phenolic oxygen and/or thiol sulfur from heavy petroleum oils which comprises:

(a) contacting heavy petroleum oils containing polycyclic hydroxy and/or thio aromatic compounds with effective amounts of a hydrogen donor, and a catalyst of an iron-containing porous solid, coal or coal liquefaction residue, (b) heating the mixture of (a) at elevated temperatures to evolve $H_2O$ and/or $H_2S$ from said mixture.

2. A process according to claim 1 wherein the iron-containing porous solid is iron pyrites, fly ash, bauxite, red mud or manganese nodules.

3. A process according to claim 1 wherein the heavy petroleum oil is vacuum pipestill bottoms, crude oil, reduced crude or residual oil.

4. A process according to claim 1 wherein the heavy petroleum oil is tar sands oil.

5. A process according to claim 4 wherein the tar sands oil comprises polar compounds recovered from tar sands by a double extraction process employing naphtha and methanol.

6. A process according to claim 1 wherein the heavy petroleum oil is the feed to a coking unit.

7. A process according to claim 6 wherein the feed is deasphalted tar, reduced crude or heavy resid.

8. A process according to claim 1 carried out in the presence of added gaseous hydrogen.

9. A process according to claim 1 wherein the hydrogen donor comprises tetrahydronaphthalene, or derivatives thereof.

10. A process according to claim 1 wherein the elevated temperature is 600° to 900° F.

11. A process according to claim 1 wherein the elevated temperature is 700° to 900° F.

12. A process according to claim 10 including the following additional process conditions:

the presence of hydrogen a pressure of 0 to 2500 psig and a LHSV of 0.5 to 10.

13. A process according to claim 11 including the following additional process conditions:

the presence of hydrogen a pressure of 0 to 250 psig and a LHSV of 0.5 to 10.

14. A process according to claim 1 wherein the effective amount of hydrogen donor is 10 to 40% tetralin equivalent.

15. A process according to claim 14 wherein the effective amount of hydrogen donor is 20 to 30% tetralin equivalent.

* * * * *